US007721359B2

(12) United States Patent
Tsutsui et al.

(10) Patent No.: US 7,721,359 B2
(45) Date of Patent: May 25, 2010

(54) VACUUM BREAKER, AND WATER-FEED VALVE ASSEMBLY AND WATER CLOSET PROVIDED THEREWITH

(75) Inventors: Haruo Tsutsui, Fukuoka (JP); Tsutomu Kido, Fukuoka (JP); Yukinori Kubozono, Fukuoka (JP)

(73) Assignee: Toto Ltd. (JP)

( * ) Notice: Subject to any disclaimer, the term of this patent is extended or adjusted under 35 U.S.C. 154(b) by 912 days.

(21) Appl. No.: 11/465,321

(22) Filed: Aug. 17, 2006

(65) Prior Publication Data

US 2006/0272081 A1 Dec. 7, 2006

Related U.S. Application Data

(63) Continuation of application No. PCT/JP2005/005334, filed on Mar. 24, 2005.

(30) Foreign Application Priority Data

Mar. 31, 2004 (JP) ..... 2004-104197

(51) Int. Cl.
*E03D 11/02* (2006.01)
*E03D 11/18* (2006.01)

(52) U.S. Cl. ..... 4/425; 4/423

(58) Field of Classification Search ..... 4/421, 4/422, 423, 425

See application file for complete search history.

(56) References Cited

U.S. PATENT DOCUMENTS 5,204,999 A * 4/1993 Makita et al. ..... 4/300
6,675,399 B1 1/2004 Tomita et al.
7,069,604 B2 * 7/2006 Tomita et al. ..... 4/406
7,305,721 B2 * 12/2007 Matsui et al. ..... 4/425

FOREIGN PATENT DOCUMENTS

JP 200034762 A 2/2000
JP 2003014151 A 1/2003
TW 469317 12/2001

* cited by examiner

*Primary Examiner*—Huyen Le
(74) *Attorney, Agent, or Firm*—Brooks Kushman P.C.

(57) ABSTRACT

Disclosed is a vacuum breaker having further enhanced reliability. The vacuum breaker comprises: a main body having a water inlet (26, 41), a water outlet (34, 48), a water passage (30, 44) for fluidically connecting the water inlet and the water outlet, and a first ambient-air intake port (36, 50) and a second ambient-air intake port (37, 49) for allowing the water passage to fluidically communicate with ambient air therethrough; a first valve element (28, 42); and a second valve element (32, 46) disposed downstream of the first valve element. The first valve element is designed to be movable between a first position allowing the water inlet to fluidically communicate with a zone of the water passage between the first and second valve elements, when water is permitted to pass through the water passage, and a second position allowing the first ambient-air intake port to fluidically communicate with the zone of the water passage between the first and second valve elements, when water is inhibited from passing through the water passage. The second valve element is designed to be movable between a first position allowing the zone of the water passage between the first and second valve elements to fluidically communicate with the water outlet, when water is permitted to pass through the water passage, and a second position allowing the second ambient-air intake port to fluidically communicate with the water outlet, when water is inhibited from passing through the water passage.

8 Claims, 6 Drawing Sheets

VACUUM BREAKER, AND WATER-FEED VALVE ASSEMBLY AND WATER CLOSET PROVIDED THEREWITH

CROSS-REFERENCE TO RELATED APPLICATIONS

This is a continuation of PCT international application no. PCT/JP2005/005334, with an international filing date of Mar. 24, 2005, which claims priority to JP 2004-104197, filed Mar. 31, 2004.

TECHNICAL FIELD

The present invention relates to a vacuum breaker, and a water-feed valve assembly and a water closet provided with the vacuum breaker.

BACKGROUND ART

Recent years, a water closet of a type designed to be fluidically connected directly to a water system, such as a city water line, and fed with flushing water directly from the water system has come into wide use. In this type of water closet, a water system and a line for supplying flushing water to a bowl are in direct fluid communication with one another through a water-feed valve. Therefore, there is a conceivable risk that a negative pressure generated in the water system from some cause, such as cut-off of water, causes a backflow of flushing water from the water closet to the water system. In order to avoid such a risk, this type of water closet is equipped with a vacuum beaker for eliminating the backflow. Japanese Patent Laid-Open Publication No. 2001-182122 discloses a flushing-water feed device provided with a vacuum breaker disposed on a downstream side of a water-feed valve so as to eliminate such a backflow. This vacuum breaker is operable, when water is permitted to pass through the water-feed valve (in a flow state), to provide fluid communication between the water-feed valve and a flushing-water supply line to a water closet, and, when water is inhibited from passing through the water-feed valve (in a non-flow state), to open the flushing-water supply line to ambient air. In the water closet equipped with this vacuum breaker, the flushing-water supply line is opened to ambient air in the non-flow state, and, in the event that a negative pressure is generated in the water system, the ambient air is taken into the water system to eliminate the risk of backflow of flushing water from the supply line to the water system.

Patent Publication 1: Japanese Patent Laid-Open Publication No. 2001-182122

DISCLOSURE OF THE INVENTION

Performance and reliability of the vacuum breaker for avoiding the backflow have already been sufficiently proven through its actual usage, and the possibility of failure or malfunction would be extremely low. However, in connection with the growing importance of risk management in recent years, there is an increasing need for taking measures against possible risks in advance. Form this point of view, it is required to take action for further improvement in reliability of a vacuum breaker as with other components.

It is therefore an object of the present invention to provide a vacuum breaker having further enhanced reliability, and a water-feed valve assembly and a water closet provided with the vacuum breaker.

In order to achieve the above object, according to a first aspect of the present invention, there is provided a vacuum breaker comprising: a main body having a water inlet, a water outlet, a water passage for fluidically connecting the water inlet and the water outlet, and first and second ambient-air intake ports for allowing the water passage to fluidically communicate with ambient air therethrough; a first valve element disposed in the main body; and a second valve element disposed in the main body at a position downstream of the first valve element. The first valve element is designed to be movable between a first position where the first valve element closes the first ambient-air intake port and opens the water inlet so as to allow the water inlet to fluidically communicate with a zone of the water passage between the first and second valve elements, when water is permitted to pass through the water passage, and a second position where the first valve element closes the water inlet and opens the first ambient-air intake port so as to allow the first ambient-air intake port to fluidically communicate with the zone of the water passage between the first and second valve elements, when water is inhibited from passing through the water passage, and the second valve element is designed to be movable between a first position where the second valve element closes the second ambient-air intake port and opens the zone of the water passage between the first and second valve elements so as to allow the zone of the water passage between the first and second valve elements to fluidically communicate with the water outlet, when water is permitted to pass through the water passage, and a second position where the second valve element closes the zone of the water passage between the first and second valve elements and opens the second ambient-air intake port so as to allow the second ambient-air intake port to fluidically communicate with the water outlet, when water is inhibited from passing through the water passage.

In the above vacuum breaker of the present invention, when water is permitted to pass through the water passage (in a flow state), the first and second valve elements are moved to provide fluid communication between the water inlet and the water outlet while closing the first and second ambient-air intake ports, respectively. Thus, water can flow from the water inlet to the water outlet. When water is inhibited from passing through the water passage (in a non-flow state), the first valve element and the second valve element are moved to close the water inlet and the water passage zone between the first and second valve elements, respectively, while allowing the first ambient-air intake port to fluidically communicate with the water passage zone between the first and second valve elements and allowing the water outlet to fluidically communicate with the second ambient-air intake port. In this manner, in the non-flow state, the water inlet is closed, and the first ambient-air intake port is opened. Thus, in the event that a negative pressure is generated on an upstream side of the water inlet, the first valve element can prevent water backflow or a phenomenon that water downstream of the water outlet is sucked toward the upstream of the water inlet. In addition, even if a malfunction of the first valve element occurring in the non-flow state causes an undesirable situation where the water inlet remains open and the first ambient-air intake port remains closed, the second valve which closes the water passage zone between the first and second valve elements and opens the second ambient-air intake port can prevent the backflow.

As above, the vacuum breaker of the present invention can prevent the backflow even if a malfunction occurs in either one of the first and second valve elements. This makes it possible to provide enhanced reliability to the vacuum breaker.

In the vacuum breaker of the present invention, it is preferable that the first and second valve elements are different from one another in motion type.

The first and second valve elements different in motion type make it possible to significantly reduce the probability that a malfunction simultaneously occurs in the first and second valve elements due to the same causal factor, so as to provide further enhanced reliability.

In this case, it is preferable that one of the first and second valve elements is a linear motion-type of valve element, and the other thereof is a swing-type valve element.

Preferably, the vacuum breaker of the present invention further includes a water-receiving member for receiving therein water spilling out of the first ambient-air intake port, and a transfer line for allowing water spilling out of the second ambient-air intake port to flow in the water-receiving member.

Alternatively, the vacuum breaker of the present invention may further include a water-receiving member for receiving therein water spilling out of the second ambient-air intake port, and a transfer line for allowing water spilling out of the first ambient-air intake port to flow in the water-receiving member.

In the above vacuum breaker, water spilling out of the first ambient-air intake port flows in the water-receiving member, and water spilling out of the second ambient-air intake port flows in the water-receiving member through the transfer line.

Thus, water spilling from the two ambient-air intake ports can be collected to and drained away from a single common location.

According to a second aspect of the present invention, there is provided a vacuum breaker comprising: a main body having a water inlet, a water outlet, a water passage for fluidically connecting the water inlet to the water outlet, and an ambient-air intake port for allowing the water passage to fluidically communicate with ambient air therethrough; a valve element disposed in the main body and designed to be movable between a first position where the valve element closes the ambient-air intake port and opens the water inlet so as to allow the water inlet to fluidically communicate with the water outlet, when water is permitted to pass through the water passage, and a second position where the valve element closes the water inlet and opens the ambient-air intake port so as to allow the ambient-air intake port to fluidically communicate with the water outlet, when water is inhibited from passing through the water passage; operation detection means for detecting an operational state of the valve element; and control means operable, when the operation detection means detects a malfunction of the valve element, to generate an alarm or to shut off the fluid communication with a water system.

In the above vacuum breaker of the present invention, when water is permitted to pass through the water passage (in a flow state), the valve element is moved to provide fluid communication between the water inlet and the water outlet while closing the ambient-air intake port. Thus, water can flow from the water inlet to the water outlet. When water is inhibited from passing through the water passage (in a non-flow state), the valve element is moved to close the water inlet and allow the water outlet to fluidically communicate with the ambient-air intake port. In this manner, in the non-flow state, the water inlet is closed, and the ambient-air intake port is opened. Thus, in the event that a negative pressure is generated on an upstream side of the water inlet, the valve element can prevent water backflow or a phenomenon that water downstream of the water outlet is sucked toward the upstream of the water inlet. Further, the operation detection means detects an operational state of the valve element. When the operation detection means detects a malfunction of the valve element, the control means generates an alarm or shuts off the fluid communication with the water system.

Thus, the operation detection means designed to detect an operational state of the valve element allows a user to quickly cope with a malfunction of the valve element, or allows the fluid communication with the water system to be shut off in response to occurrence of a malfunction of the valve element to prevent water backflow due to a negative pressure generated in the water system.

According to a third aspect of the present invention, there is provided a water-feed valve assembly comprising: the vacuum breaker set forth in the first or second of the present invention; a main valve element designed to selectively provide fluid communication between a water system and the water inlet of the vacuum breaker, and shut off the fluid communication between the water system and the water inlet of the vacuum breaker; and a water discharge line fluidically connected to the water outlet of the vacuum breaker.

According to a fourth aspect of the present invention, there is provided a water-feed valve assembly for supplying flushing water to a water closet of a type designed to be fluidically connected directly to a water system. The water-feed valve assembly comprises: a rim-side water discharge line for allowing flushing water to be discharged from a rim portion of the water closet; a first vacuum breaker consisting of the vacuum breaker set forth in the first or second aspect of the present invention, wherein the water outlet of the first vacuum breaker is fluidically connected to the rim-side water discharge line; a jet-side water discharge line for allowing flushing water to be discharged from a jet nozzle of the water closet; a second vacuum breaker consisting of the vacuum breaker set forth in the first or second aspect of the present invention, wherein the water outlet of the second vacuum breaker is fluidically connected to the jet-side water discharge line; a main valve element interposed in a connection line to a water system and designed to switch between a water stop state and a water discharge state; and a selector valve designed to allow flushing water fed from the water system through the main valve element to be selectively led to either one of the water inlet of the first vacuum breaker and the water inlet of the second vacuum breaker.

According to a fifth aspect of the present invention, there is provided a water closet comprising: a water closet body including a bowl which has an upper portion formed as a rim portion, and a jet nozzle disposed at a bottom portion of the bowl; and the water-feed valve assembly set forth in the fourth aspect of the present invention.

As mentioned above, the present invention can provide a vacuum breaker having further enhanced reliability, and a water-feed valve assembly and a water closet provided with the vacuum breaker.

BEST MODE FOR CARRYING OUT THE INVENTION

With reference to the accompanying drawings, an embodiment of the present invention will now be described.

Figure 1:
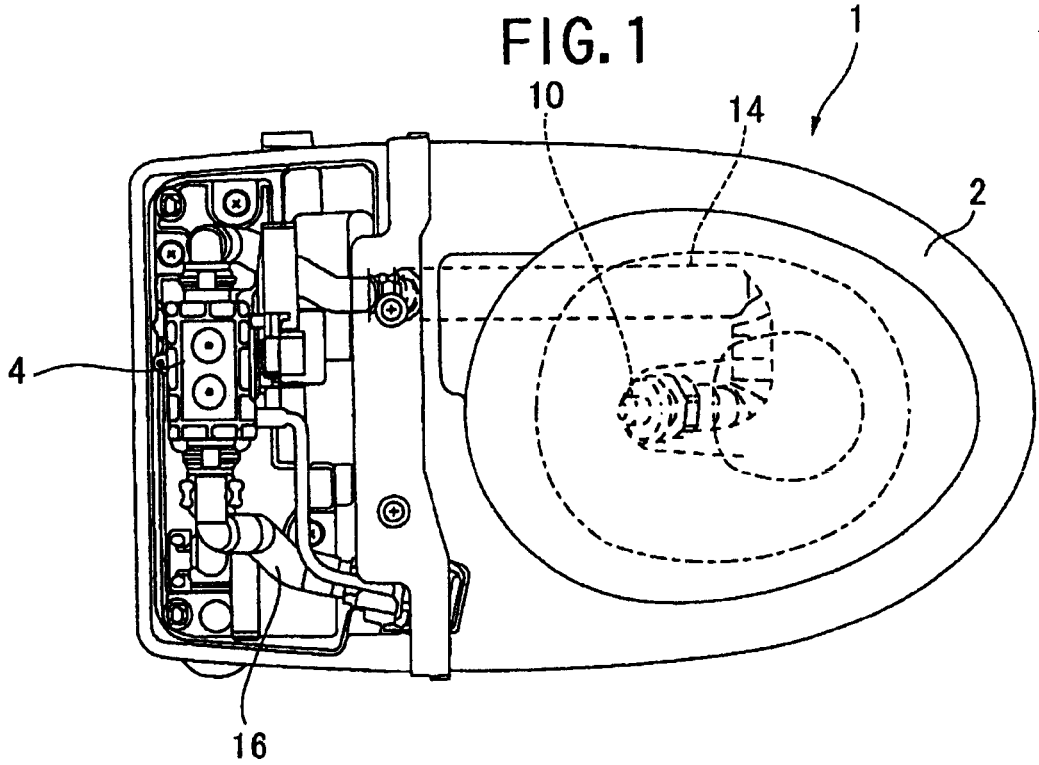
FIG. 1 is a top view showing a water closet according to a first embodiment of the present invention.
Figure 2:
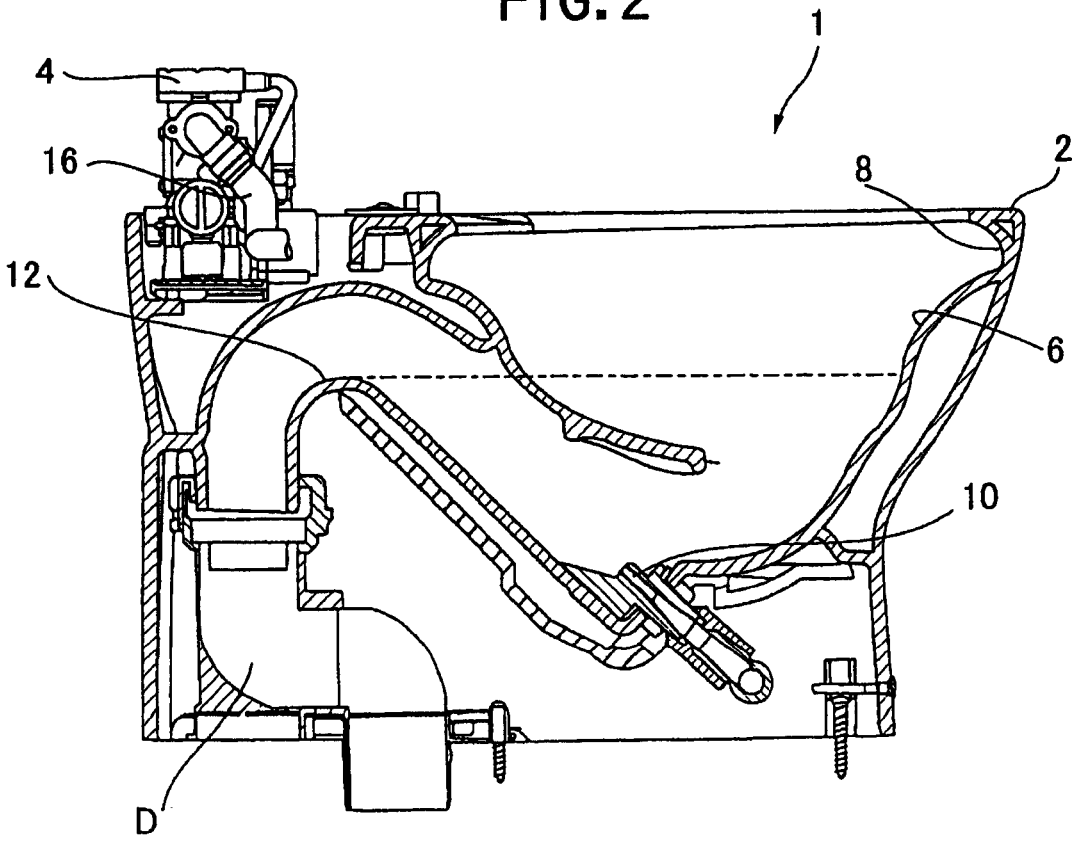
FIG. 2 is a sectional side view showing the water closet according to the first embodiment.
Figure 3:
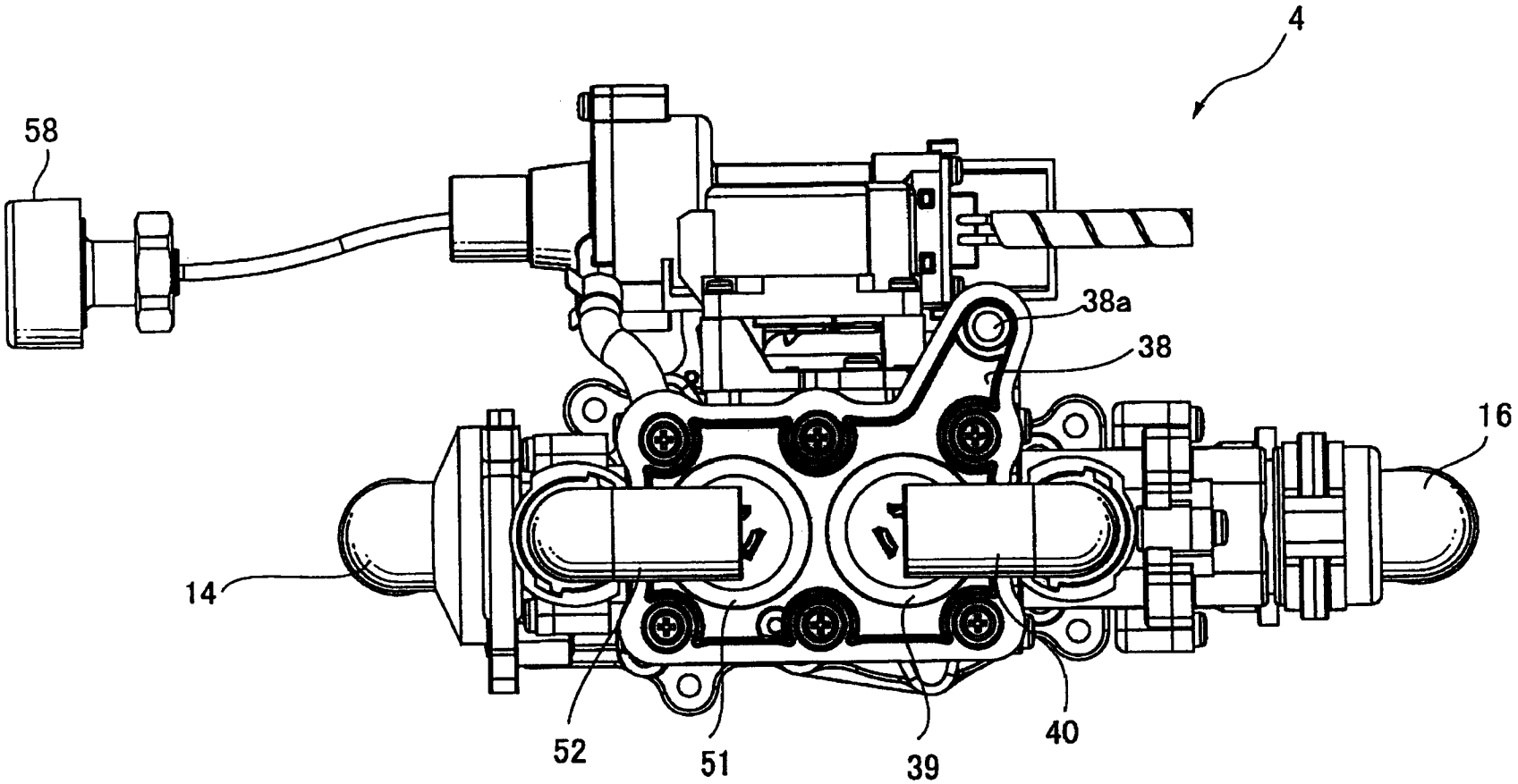
FIG. 3 is a top view showing a water-feed valve assembly used in the water closet according to the first embodiment.
Figure 4:
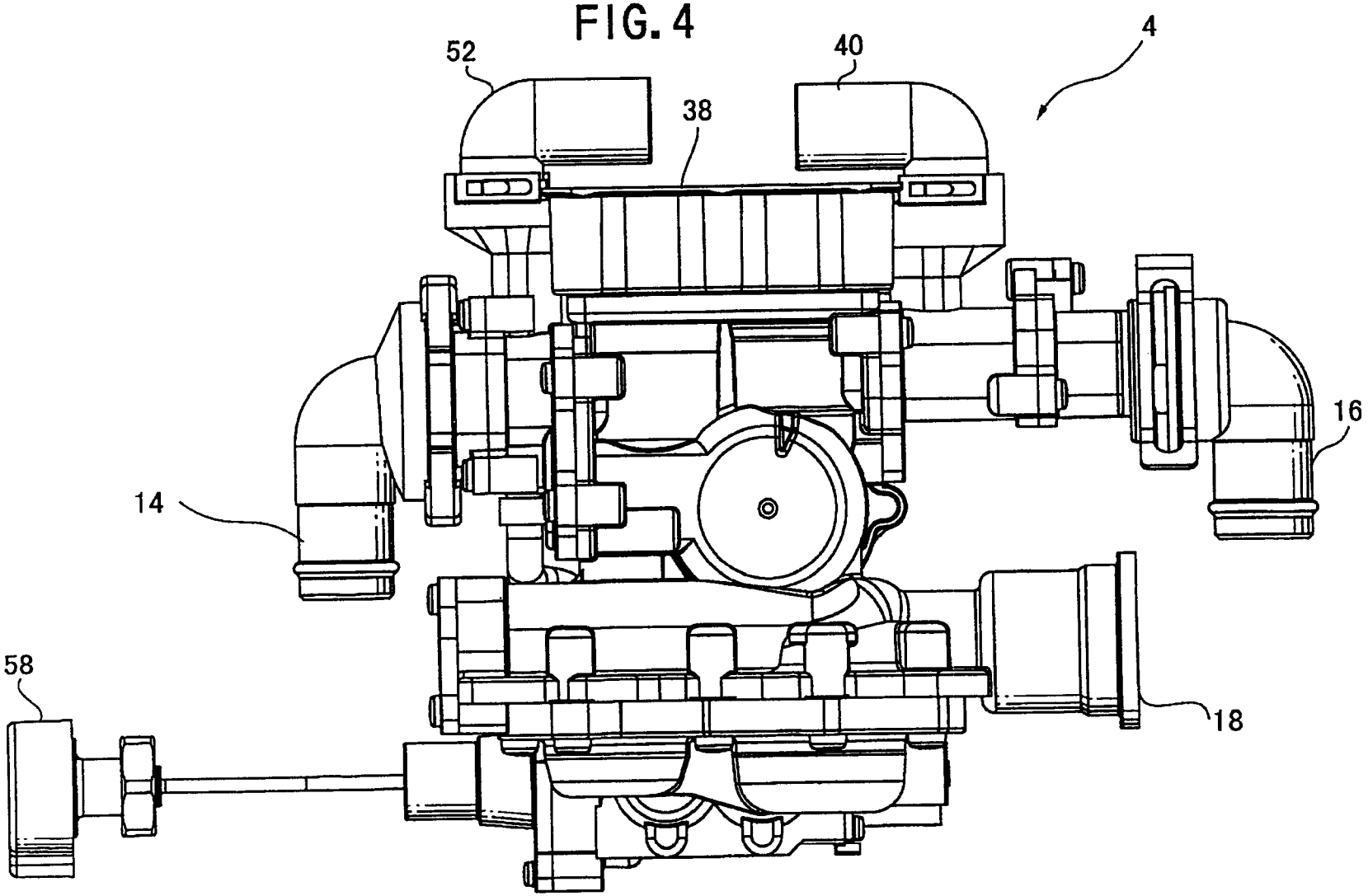
FIG. 4 is a front view showing the water-feed valve assembly used in the water closet according to the first embodiment.
Figure 5:
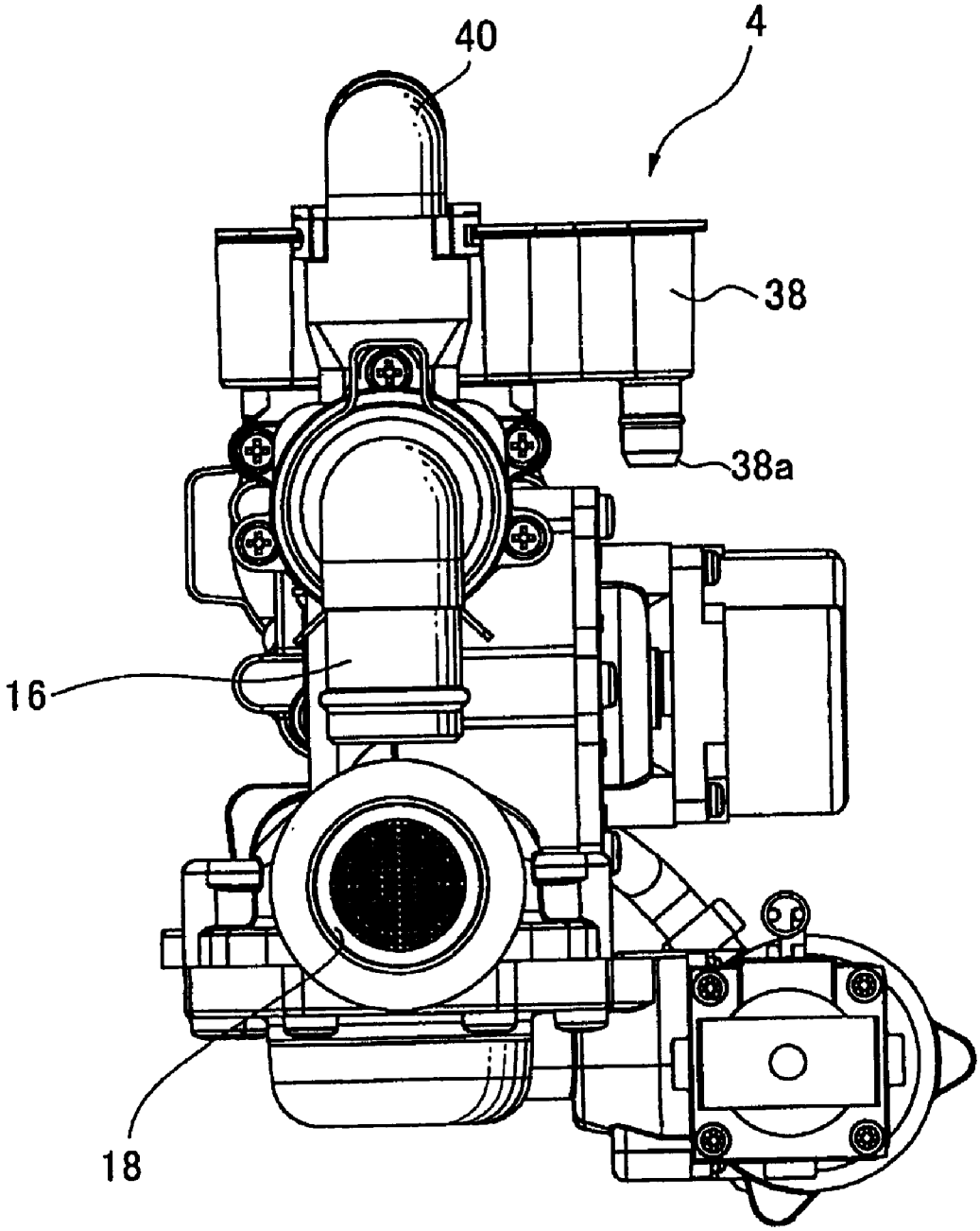
FIG. 5 is a side view showing the water-feed valve assembly used in the water closet according to the first embodiment.
Figure 6:
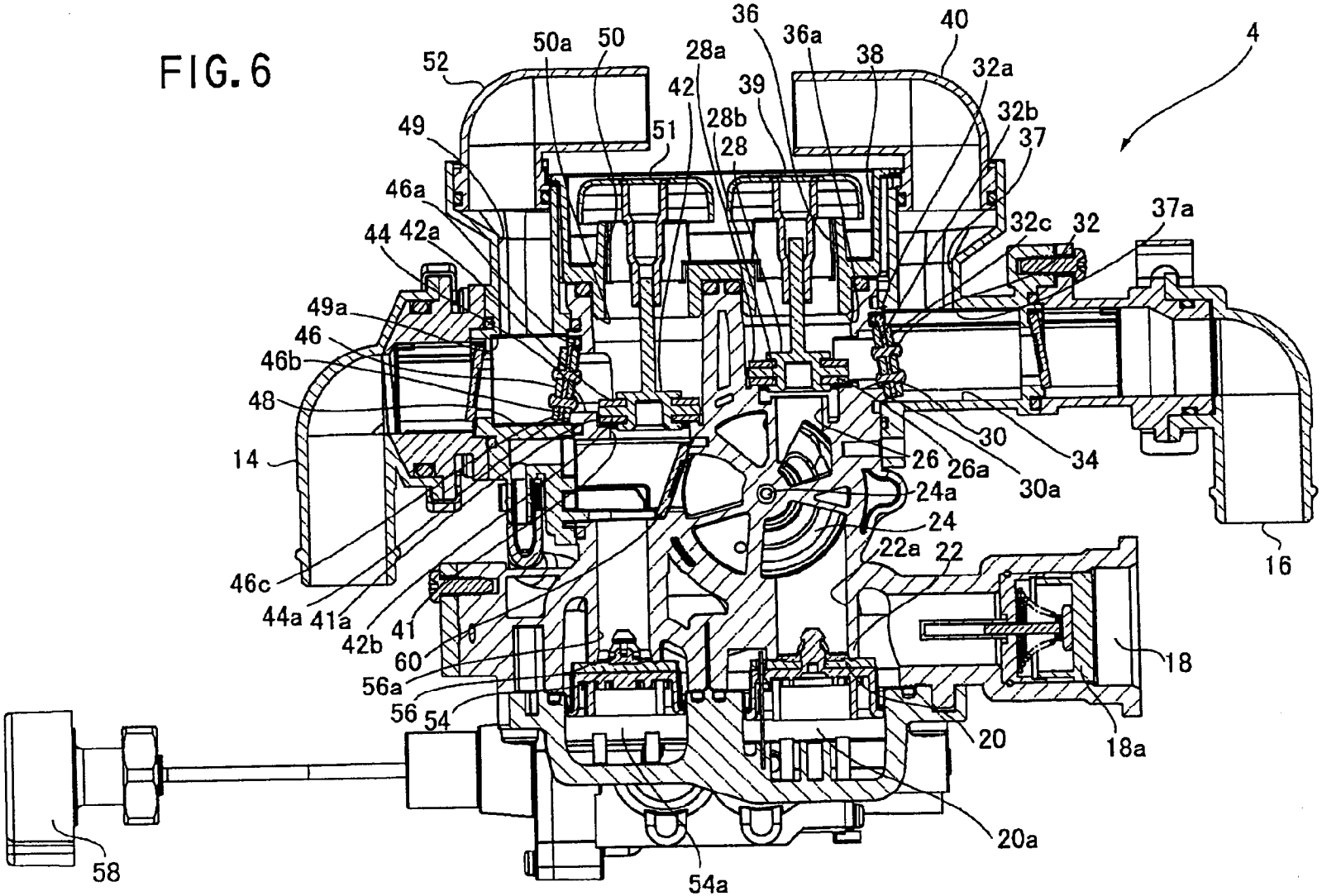
FIG. 6 is a full sectional view showing the water-feed valve assembly used in the water closet according to the first embodiment.

Firstly, with reference to FIGS. 1 to 6, a water closet according to a first embodiment of the present invention will be described. FIGS. 1 and 2 are, respectively, a top view and a sectional side view showing the water closet according to the first embodiment. FIGS. 3 to 6 are, respectively, a top view, a front view, a side view and a full sectional view showing a water-feed valve assembly used in the water closet according to the first embodiment.

As shown in FIGS. 1 and 2, a water closet 1 according to the first embodiment comprises a water closet body 2, and a water-feed valve assembly 4 disposed at a rear end of the water closet 2. The water closet body 2 includes a bowl 6 having an upper end portion formed as a rim portion 8, a jet nozzle 10 disposed at a bottom portion of the bowl 6, and a trap line 12 which is formed to extend obliquely upward from the bottom portion of the bowl 6 and then curve downward, and fluidically connected to a drain line D. The water-feed valve assembly 4 is designed to selectively supply clean water fed from a water system, such as a city water line (not shown), to either one of the rim portion 8 and the jet nozzle 10 as flushing water. The flushing water from the water-feed valve assembly 4 is supplied to the jet nozzle 8 and rim portion 8, respectively, through a jet-side water discharge line 14 and a rim-side water discharge line 16. More specifically, the water-feed assembly 4 is operable to supply clean water fed from the water system (not shown) to the rim portion 8→the jet nozzle 10→the rim portion 8 in this order so as to allow flushing water to be discharged from each of the rim portion 8 and the jet nozzle 10 for a given time period.

As shown in FIGS. 3 to 6, the water-feed valve assembly 4 has an inlet (valve inlet) 18 adapted to be fluidically connected to the water system, a main valve element 20 designed to switch a state of flushing water consisting of clean water inflowing from the valve inlet 18 between a water discharge state and a water stop state, a valve seat 22 adapted to allow the main valve element 20 to be seated thereon, and a rotor 24 serving as a selector valve for selectively directing the flushing water inflowing through the valve seat 22, toward either one of the rim portion 8 and the jet nozzle 10.

The water-feed valve assembly 4 also has a rim-side water inlet 26 for allowing the flushing water directed toward the rim portion 8 by the rotor 24 to flow in therethrough, a first rim-side valve element 28 for opening and closing the rim-side water inlet 26, a rim-side water passage 30 for allowing the flushing water passing through the first rim-side valve element 28 to flow therein, a second rim-side valve element 32 disposed downstream of the first rim-side valve element 28, and a rim-side water outlet 34 for allowing the flushing water passing through the second rim-side valve element 32 to flow out therethrough. Further, the water-feed valve assembly 4 has a cylindrical-shaped first rim-side ambient-air intake port 36 formed above the first rim-side valve element 28, and a second rim-side ambient-air intake port 37 formed above the second rim-side valve element 32. Furthermore, the water-feed valve assembly 4 includes a water-receiving member 38 formed around the first rim-side ambient-air intake port 36 in such a manner as to surround the first rim-side ambient-air intake port 36, a rim-side cover 39 disposed above the first rim-side ambient-air intake port 36 to cover the first rim-side ambient-air intake port 36, and a rim-side transfer line 40 formed of a L-shaped pipe and fluidically connected to an upper end of the second rim-side ambient-air intake port 37. A combination of the rim-side water inlet 26, the first rim-side valve element 28, the rim-side water passage 30, the second rim-side valve element 32, the rim-side water outlet 34, the first rim-side ambient-air intake port 36, the second rim-side ambient-air intake port 37, the water-receiving member 38, the rim-side cover 39 and the rim-side transfer line 40 serves as a rim-side vacuum breaker. Among them, a combination of respective members defining the rim-side water inlet 26, the rim-side water outlet 34, the rim-side water passage 30, the first rim-side ambient-air intake port 36 and the second rim-side ambient-air intake port 37 serves as a main body of the rim-side vacuum breaker.

In a similar configuration, the water-feed valve assembly 4 has a jet-side water inlet 41 for allowing the flushing water directed toward the jet nozzle 10 by the rotor 24 to flow in therethrough, a first jet-side valve element 42 for opening and closing the jet-side water inlet 41, a jet-side water passage 44 for allowing the flushing water passing through the first jet-side valve element 42 to flow therein, a second jet-side valve element 46 disposed downstream of the first jet-side valve element 42, and a jet-side water outlet 48 for allowing the flushing water passing through the second jet-side valve element 46 to flow out therethrough. Further, the water-feed valve assembly 4 has a cylindrical-shaped first jet-side ambient-air intake port 50 formed above the first jet-side valve element 42, and a second jet-side ambient-air intake port 49 formed above the second jet-side valve element 46. The above water-receiving member 38 is formed to surround the first jet-side ambient-air intake port 50 as well as the first rim-side ambient-air intake port 36. Furthermore, the water-feed valve assembly 4 includes a jet-side cover 51 disposed above the first jet-side ambient-air intake port 50 to cover the first jet-side ambient-air intake port 50, and a jet-side transfer line 52 formed of a L-shaped pipe and fluidically connected to an upper end of the second jet-side ambient-air intake port 49. A combination of the jet-side water inlet 41, the first jet-side valve element 42, the jet-side water passage 44, the second jet-side valve element 46, the jet-side water outlet 48, the first jet-side ambient-air intake port 50, the second jet-side ambient-air intake port 49, the water-receiving member 38, the jet-side cover 51 and the jet-side transfer line 52 serves as a jet-side vacuum breaker. Among them, a combination of respective members defining the jet-side water inlet 41, the jet-side water outlet 48, the jet-side water passage 44, the first jet-side ambient-air intake port 50 and the second jet-side ambient-air intake port 49 serves as a main body of the jet-side vacuum breaker.

The water-feed valve assembly 4 includes a manually-operated main valve element 54, a valve seat 56 adapted to allow the manually-operated main valve element 54 to be seated thereon, and a swingable plate 60 interposed in a line 56*a* extending from the valve seat 56. The water-feed valve assembly 4 also includes a manual operation member 58 for manually operating respective internal pressures of a pressure chamber 54*a* of the manually-operated main valve element 54 and a pressure chamber 20*a* of the main valve element 20.

The valve inlet 18 adapted to be fluidically connected to the water system includes a constant flow valve 18*a* disposed therein and designed to allow a given amount of clean water from the water system to flow in the water-feed valve assembly 4. A line downstream of the constant flow valve 18*a* is in fluid communication with the valve seat 22, and the main valve element 20 is disposed adjacent to the valve seat 22. In the water discharge state when the main valve element 20 is away from the valve seat 22, flushing water inflowing from the valve inlet 18 and passing through the constant flow valve 18*a* passes through the valve seat 22 and flows into a vertical line 22*a* extending from the valve seat 22. The pressure chamber 20*a* is formed on the side of a back surface of the main valve element 20 or on the opposite side of the valve seat 22 on the basis of the main valve element 20. The pressure chamber 20*a* is in communication with the water system. Thus, in the water stop state, a primary pressure or a water pressure in the water system is applied as an internal pressure of the pressure chamber 20*a*. That is, when the primary pressure is applied as an internal pressure of the pressure chamber 20*a*, the main valve element 20 is pressed upward by the internal pressure of the pressure chamber 20*a* and seated on the valve seat 22 to establish the water stop state. This pressure chamber 20*a* is provided with a solenoid valve (not shown) designed to be closed so as to allow the primary pressure to be applied as an internal pressure of the pressure chamber 20*a* and to be opened so as to release and reduce the interior pressure of the pressure chamber 20*a*. That is, when the solenoid valve is opened to reduce the interior pressure of the pressure chamber 20*a*, the main valve element 20 is moved away from the valve seat 20 to establish the water discharge state.

The rotor 24 is disposed downstream of the valve seat 22, and designed to selectively lead the flushing water flowing in the line 22*a* through the valve seat 22 toward either one of the rim portion and the jet nozzle. The rotor 24 comprises a sector-shaped member designed to be rotated about a center shaft 24*a* in such a manner as to allow the line 22*a* to fluidically communicate with either one of the rim-side water inlet 26 and the jet-side water inlet 41.

The first rim-side valve element 28 is composed of a linear motion-type of valve element having a bottom surface and a top surface provided, respectively, with a packing 28*a* and a packing 28*b*. In the water stop state, the first rim-side valve element 28 is seated on a seat face 26*a* formed on the rim-side water inlet 26 through the packing 28*a* thereof based on its own weight to close the rim-side water inlet 26. Simultaneously, the first rim-side ambient-air intake port 36 is allowed to come into fluid communication with the rim-side water passage 30 which is a water passage between the first rim-side valve element 28 and the second rim-side valve element 32. In the water discharge state, the first rim-side valve element 28 is pushed upward by a force of inflowing flushing water, and the packing 28*b* of the first rim-side valve element 28 is seated on a seat face 36*a* formed at a lower end of the first rim-side ambient-air intake port 36 to close the first rim-side ambient-air intake port 36. Simultaneously, the rim-side water inlet 26 is allowed to come into fluid communication with the rim-side water passage 30.

The first rim-side ambient-air intake port 36 is designed to have a sectional area approximately equal to that of the water passage, such as the rim-side water inlet 26. Thus, in the event of a negative pressure is generated in the water system, ambient air can be introduced therethrough in a sufficiently large volume to significantly reduce a force of sucking flushing water residing on a downstream side of the first rim-side ambient-air intake port 36.

The second rim-side valve element 32 is composed of a swing-type of valve element designed to be swung about a rotatable shaft 32*a*. The second rim-side valve element 32 has a front surface and a rear surface provided, respectively, with a packing 32*b* and a packing 32*c*. In the water stop state, the second rim-side valve element 32 is seated on a seat face 30*a* formed on the rim-side water passage 30 through the packing 32*b* thereof based on its own weight to close the rim-side water passage 30. Simultaneously, the second rim-side ambient-air intake port 37 is allowed to come into fluid communication with the rim-side water outlet 34. In the water discharge state, the second rim-side valve element 32 is swung upward by a force of inflowing flushing water, and the packing 32*c* of the second rim-side valve element 32 is seated on a seat face 37*a* formed at a lower end of the second rim-side ambient-air intake port 37 to close the second rim-side ambient-air intake port 37. Simultaneously, the rim-side water passage 30 is allowed to come into fluid communication with the rim-side water outlet 34. The seat face 30*a* of the rim-side water passage 30 is formed to be inclined relative to a vertical line in a direction facing upward by about 5 to 10 degrees. Thus, the second rim-side valve element 32 swung based on its own weight in the water stop state can be reliably seated on the seat face 30*a*.

The second rim-side ambient-air intake port 37 is designed to have a sectional area approximately equal to that of the water passage, such as the rim-side water passage 30. Thus, in the event of a negative pressure is generated in the water system, ambient air can be introduced therethrough in a sufficiently large volume to significantly reduce a force of sucking flushing water residing on a downstream side of the second rim-side ambient-air intake port 37.

The water-receiving member 38 is composed of a rectangular parallelepiped-shaped water tank formed to surround respective exit portions of the first rim-side ambient-air intake port 36 and the first jet-side ambient-air intake port 50. The water-receiving member 38 is designed to receive therein flushing water spilling out of the first ambient-air intake ports 36, 50, for example, when the first rim-side valve element 28 and the first jet-side valve element 42 close the first ambient-air intake ports 36, 50, respectively. Further, the rim-side cover 39 and the jet-side cover 51 are disposed above the corresponding first ambient-air intake ports 36, 50 to cover the corresponding first ambient-air intake ports 36, 50 in such a manner as to prevent flushing water spilling out of the first ambient-air intake ports 36, 50 from being splashed outside the water-receiving member 38. The water-receiving member 38 has a bottom portion formed with a drain hole 38*a* which is fluidically connected to a water passage in fluid communication with the rim-side water discharge line 16, through a water discharge tube (not shown). Thus, flushing water spilling out of the first ambient-air intake ports 36, 50 is received by the water-receiving member 38 and discharged from the rim-side water discharge line 16 through the drain hole 38*a*.

The rim-side transfer line 40 is composed of an L-shaped bent pipe, and attached to the upper end of the second rim-side ambient-air intake port 37 to extend up to a position above the water-receiving member 38. This rim-side transfer line 40 is designed to lead flushing water spilling out of the second rim-side ambient-air intake port 37, to the water-receiving member 38, for example, when the second rim-side ambient-air intake port 37 is closed by the second rim-side valve element 32.

The first jet-side valve element 42 is composed of a linear motion-type of valve element having a bottom surface and a top surface provided, respectively, with a packing 42*a* and a packing 42*a*. In the water stop state, the first jet-side valve element 42 is seated on a seat face 41 a formed on the jet-side water inlet 41 through the packing 42*b* thereof based on its own weight to close the jet-side water inlet 41. Simultaneously, the first jet-side ambient-air intake port 50 is allowed to come into fluid communication with the jet-side water passage 44 which is a water passage between the first jet-side valve element 42 and the second jet-side valve element 46. In the water discharge state, the first jet-side valve element 42 is pushed upward by a force of inflowing flushing water, and the packing 42*a* of the first jet-side valve element 42 is seated on a seat face 50*a* formed at a lower end of the first jet-side ambient-air intake port 50 to close the first jet-side ambient-air intake port 50. Simultaneously, the jet-side water inlet 41 is allowed to come into fluid communication with the jet-side water passage 44.

The first jet-side ambient-air intake port 50 is designed to have a sectional area approximately equal to that of the water passage, such as the jet-side water inlet 41. Thus, in the event of a negative pressure is generated in the water system, ambient air can be introduced therethrough in a sufficiently large volume to significantly reduce a force of sucking flushing water residing on a downstream side of the first jet-side ambient-air intake port 50.

The second jet-side valve element 46 is composed of a swing-type of valve element designed to be swung about a rotatable shaft 46*a*. The second jet-side valve element 46 has a front surface and a rear surface provided, respectively, with a packing 46*b* and a packing 46*c*. In the water stop state, the second jet-side valve element 46 is seated on a seat face 44*a* formed on the jet-side water passage 44 through the packing 46*b* thereof based on its own weight to close the jet-side water passage 44. Simultaneously, the second jet-side ambient-air intake port 49 is allowed to come into fluid communication with the jet-side water outlet 48. In the water discharge state, the second rim-side valve element 32 is swung upward by a force of inflowing flushing water, and the packing 46*c* of the second jet-side valve element 46 is seated on a seat face 49*a* formed at a lower end of the second jet-side ambient-air intake port 49 to close the second jet-side ambient-air intake port 49. Simultaneously, the jet-side water passage 44 is allowed to come into fluid communication with the jet-side water outlet 48. The seat face 44*a* of the jet-side water passage 44 is formed to be inclined relative to a vertical line in a direction facing upward by about 5 to 10 degrees. Thus, the second jet-side valve element 46 swung based on its own weight in the water stop state can be reliably seated on the seat face 44*a*.

The second jet-side ambient-air intake port 49 is designed to have a sectional area approximately equal to that of the water passage, such as the jet-side water passage 44. Thus, in the event of a negative pressure is generated in the water system, ambient air can be introduced therethrough in a sufficiently large volume to significantly reduce a force of sucking flushing water residing on a downstream side of the second jet-side ambient-air intake port 49.

The jet-side transfer line 52 is composed of an L-shaped bent pipe, and attached to the upper end of the second jet-side ambient-air intake port 49 to extend up to a position above the water-receiving member 38. This jet-side transfer line 52 is designed to lead flushing water spilling out of the second jet-side ambient-air intake port 49, to the water-receiving member 38, for example, when the second jet-side ambient-air intake port 49 is closed by the second jet-side valve element 46.

The manually-operated main valve element 54 is disposed in side-by-side relation to the main valve element 20, and seated on the valve seat 56. While water fed from the water system through the valve inlet 18 is filled around the valve seat 56, the manually-operated main valve element 54 is kept in a closed position in a normal state, and thereby this water never flows through the valve seat 56. Further, the pressure chamber 54*a* formed on the side of the back surface of the manually-operated main valve element 54 allows the manually-operated main valve element 54 to be pressed onto the valve seat 54 by the primary pressure of the water system in the pressure chamber 54*a*. In the normal state, an internal pressure of the pressure chamber 54*a* is maintained at the primary pressure.

The swingable plate 60 is swingably attached to an upper end of the line 56*a*, and designed to close a water passage extending from the rotor 24 to the jet-side water inlet 41 when flushing water flows into the line 56*a* through the valve seat 56 and to close the line 56*a* when flushing water inflows from the rotor 24. Further, the manually-operated main valve element 54 is designed to be manually operated by a user when the solenoid valve (not shown) is not activated due to a power failure or the like, so as to control respective internal pressures of the pressure chambers 20*a*, 54*a*.

With reference to FIGS. 1 to 6, an operation of the water closet 1 according to the first embodiment of the present invention will be described below.

In a standby state before a user of the water closet 1 performs a flushing operation, the pressure chambers 20*a* and 54*a* is closed to allow the primary pressure of the water system to be applied as an internal pressure of the pressure chambers 20*a* and 54*a*. Thus, the main valve element 20 and the manually-operated main valve element 54 are pressed, respectively, onto the valve seat 22 and the valve seat 56 to establish the water stop state. The rotor 24 is set at a position where it provides fluid communication between the line 22*a* and the rim-side water inlet 26 and shuts off between the line 22*a* and the jet-side water inlet 41. The first rim-side valve element 28 is seated on the seat face 26*a* based on its own weight to close the rim-side water inlet 26, and the first jet-side valve element 42 is seated on the seat face 41*a* based on its own weight to close the jet-side water inlet 41. The second rim-side valve element 32 is swung to the lowermost position by its own weight and seated on the seat face 30*a* to close the rim-side water passage 30. Further, the second jet-side valve element 46 is swung to the lowermost position by its own weight and seated on the seat face 44*a* to close the jet-side water passage 44. In this state, each of the first rim-side ambient-air intake port 36, the second rim-side ambient-air intake port 37, the first jet-side ambient-air intake port 50 and the second jet-side ambient-air intake port 49 is opened.

Then, in response to the flushing operation by the user, the solenoid valve (not shown) is opened to reduce the interior pressure of the pressure chamber 20*a*. In conjunction with the reduced interior pressure of the pressure chamber 20*a*, a pressure allowing the main valve element 20 to be seated on the valve seat 22 is reduced, and the main valve element 20 is moved away from the valve seat 22 to establish the water discharge state. When the main valve element 20 is opened, flushing water inflowing from the valve inlet 18 flows into the line 22*a* through the constant flow valve 18*a* and the valve seat 22. As mentioned above, the rotor 24 is set at the position where it provides fluid communication between the line 22*a* and the rim-side water inlet 26. Thus, the flushing water flowing in the line 22*a* reaches the rim-side water inlet 26. A stream of the flushing water reaching the rim-side water inlet 26 presses and moves the first rim-side valve element 28 upward to open the rim-side water inlet 28. When a sufficient time has elapsed after initiation of the discharge state, the first rim-side valve element 28 is brought into contact with the seat face 36*a* of the lower end of the first rim-side ambient-air intake port 36 to close the first rim-side ambient-air intake port 36. In other words, during the course where the first rim-side valve element 28 is being moved upward, both the rim-side water inlet 26 and the first rim-side ambient-air intake port 36 are in their open state. In this period, the flushing water partially spills out of the upper end of the first rim-side ambient-air intake port 36. Then, a part of the spilled water falls in the water-receiving member 38 while hitting against the rim-side cover 38, and the remaining spilled water returns to the first rim-side ambient-air intake port 36.

The flushing water flowing into the rim-side water passage 30 through the rim-side water inlet 26 swingingly moves the second rim-side valve element 32 by its stream to open the rim-side water passage 30, and reaches the rim-side water outlet 34. When a sufficient time has elapsed after initiation of the discharge state, the second rim-side valve element 32 is brought into contact with the seat face 37*a* of the lower end of the second rim-side ambient-air intake port 37 to close the second rim-side ambient-air intake port 37. In other words, during the course where the second rim-side valve element 32 is being swung upward, both the rim-side water passage 30 and the second rim-side ambient-air intake port 37 are in their open state. In this period, the flushing water partially spills out of the upper end of the second rim-side ambient-air intake port 37. Then, a part of the spilled water falls in the water-receiving member 38 through the rim-side transfer line 40, and the remaining spilled water returns to the second rim-side ambient-air intake port 37. The flushing water flowing in the water-receiving member 38 is discharged from the rim-side water discharge line 16 through the drain hole 38*a* and the water discharge tube (not shown).

The flushing water flowing in the rim-side water outlet 34 is supplied to the rim portion 8 through the rim-side water discharge line 16. Then, the flushing water flows downward while swirling around an inner wall surface of the bowl 6 to clean the inner wall surface of the bowl 6. After supplying flushing water to the rim portion 8 for a given time period, the rotor 24 is rotated and moved to a position where it provides fluid communication between the line 22*a* and the jet-side water inlet 41 and shuts off between the line 22*a* and the rim-side water inlet 26. In this embodiment, flushing water is supplied to the rim portion 8, at a flow rate of 20 L/min for about 5 seconds in a large-volume flushing operation using a larger volume of flushing water, or at a flow rate of 20 L/min for about 3 seconds in a low-volume flushing operation using a small volume of flushing water, and then the rim-side water discharge state is switched to a jet-side water discharge state.

In the state when the rotor 24 is set at the position where it provides fluid communication between the line 22*a* and the jet-side water inlet 41, the flushing water flowing in the line 22*a* reaches the jet-side water inlet 41. A stream of the flushing water reaching the jet-side water inlet 41 presses and moves the first jet-side valve element 42 upward to open the jet-side water inlet 41. When a sufficient time has elapsed after being switched to the jet-side water discharge state, the first jet-side valve element 42 is brought into contact with the seat face 50*a* of the lower end of the first jet-side ambient-air intake port 50 to close the first jet-side ambient-air intake port 50. In other words, during the course where the first jet-side valve element 42 is being moved upward, both the jet-side water inlet 41 and the first jet-side ambient-air intake port 50 are in their open state. In this period, the flushing water partially spills out of the upper end of the first jet-side ambient-air intake port 50. Then, a part of the spilled water falls in the water-receiving member 38 while hitting against the jet-side cover 51, and the remaining spilled water returns to the first jet-side ambient-air intake port 50.

The flushing water flowing into the jet-side water passage 44 through the jet-side water inlet 41 swingingly moves the second jet-side valve element 46 by its stream to open the jet-side water passage 44, and reaches the jet-side water outlet 48. When a sufficient time has elapsed after being switched to the jet-side water discharge, the second jet-side valve element 46 is brought into contact with the seat face 49*a* of the lower end of the second jet-side ambient-air intake port 49 to close the second jet-side ambient-air intake port 49. In other words, during the course where the second jet-side valve element 46 is being swung upward, both the jet-side water passage 44 and the second jet-side ambient-air intake port 49 are in their open state. In this period, the flushing water partially spills out of the upper end of the second jet-side ambient-air intake port 49. Then, a part of the spilled water falls in the water-receiving member 38 through the jet-side transfer line 52, and the remaining spilled water returns to the second jet-side ambient-air intake port 49.

The flushing water flowing out of the jet-side water outlet 48 is supplied to the jet nozzle 10 through the jet-side water discharge line 14 to fill the trap line 12 with the flushing water so as to generate a siphon phenomenon. Thus, by the action of the siphon phenomenon, the flushing water and feculences in the bowl 6 is sucked in the trap line 12, and discharged to the drain line D. After supplying flushing water to the jet nozzle 10 for a given time period, the rotor 24 is re-rotated and moved to the position where it provides fluid communication between the line 22*a* and the rim-side water inlet 26 and shuts off between the line 22*a* and the jet-side water inlet 41. In this embodiment, flushing water is supplied to the jet nozzle 10, at a flow rate of 20 L/min for about 5 seconds in the large-volume flushing operation, or at a flow rate of 20 L/min for about 4 seconds in the low-volume flushing operation, and then the rotor 24 is switched to the rim-side position for supplying flushing water to the rim portion.

After switching to the rim-side position, flushing water is supplied to the rim portion for a given time to allow a pooled water in the bowl 6 to be returned to a given level. Then, after supplying flushing water to the rim portion for the given time, the solenoid valve (not shown) is closed to return the interior pressure of the pressure chamber 20*a* to the primary pressure of the water system. Thus, the main valve element 20 is seated to establish the water stop state. In this embodiment, flushing water is supplied to the rim portion 8, at a flow rate of 20 L/min for about 4 seconds both in the large-volume and low-volume flushing operations, and then stopped. When the water discharge state is switched to the water stop state, the first rim-site valve element 28, the first jet-side valve element 42, each of the second rim-site valve element 32, the second jet-side valve element 46 in the open state based on flushing water stream is moved downward by its own weight, and returned to the position in the standby state. In this manner, one cycle of flushing operation is completed.

A manual flushing operation of the water closet 1 according to the first embodiment will be described below. This manual flushing operation is performed when the solenoid valve (not shown) is not activated due to a power failure or the like. When a user manually rotates the manual operation member 58, an internal pressure of the pressure chamber 20*a* is released by a cam mechanism, and thereby the main valve element 20 is moved away from the valve seat 22 to allow flushing water to be discharged from the rim portion 8. Then, when the user rotates the manual operation member 58 in the opposite direction after discharging flushing water from the rim portion 8 for a given time period, an inner pressure of the pressure chamber 54*a* is released by the cam mechanism (not shown), and thereby the manually-operated main valve element 54 is moved away from the valve seat 56 to allow flushing water to flow into the line 56*a* through the valve seat 56. A stream of the flushing water flowing in the line 56*a* presses and moves the swingable plate 60 upward to provide fluid communication between the line 56*a* and the jet-side water inlet 41. The flushing water flowing in the jet-side water inlet 41 is discharged from the jet nozzle 10. Then, when the user rotates the manual operation member 58 in the same direction as that in the initial operation after discharging flushing water from the jet nozzle 10 for a given time period, flushing water is re-discharged from the rim portion 8. In this manner, the user can manually operate the manual operation member 58 to perform the flushing operation of the water closet.

An operation of the vacuum breaker will be described below. In the event that a negative pressure is generated in a line adjacent to the valve inlet 18 from some cause, such as a water failure in a water system for feeding flushing water, flushing water filled in the water passage from the line 22*a* to the rim-side water discharge line is sucked toward the valve inlet 18. When the flushing water is sucked in a direction causing backflow, the first rim-side valve element 28 in contact with the seat face 36*a* to close the first rim-side ambient-air intake port 36 is drawn downward to open the first rim-side ambient-air intake port 36. When the first rim-side ambient-air intake port 36 is opened, ambient air is taken into the water passage through the first rim-side ambient-air intake port 36. Thus, even if a negative pressure is generated on an upstream side of the first rim-side valve element 28, ambient air is introduced from the first rim-side ambient-air intake port 36 in such as manner as to cancel the negative pressure. This makes it possible to reduce the risk that flushing water on a downstream side of the first rim-side valve element 28 comes under the influence of a negative pressure generate on the upstream thereof In this embodiment, the sectional area of the first rim-side ambient-air intake port 36 is set at a value approximately equal to the sectional area of the water passage to allow a large volume of ambient air to be taken into the water passage so as to sufficiently block the influence of a negative pressure on the upstream side of the first rim-side valve element 28.

Then, when the first rim-side valve element 28 is further moved downward after being moved away from the seat face 36*a*, and brought into contact with the seat face 26*a* of the rim-side water inlet 26, the rim-side water inlet 26 is closed to preclude a negative pressure on the upstream side of the first rim-side valve element 28 from exerting its influence on the downstream side of the first rim-side valve element 28. This makes it possible to prevent the flushing water on the downstream side of the first rim-side valve element 28 from flowing back toward the upstream.

If the first rim-side valve element 28 is kept at a position where it closes the first rim-side ambient-air intake port 36 due to malfunction thereof caused by some factor, such as aging, the rim-side water passage 30 will come under the influence of a negative pressure on the upstream side of the first rim-side valve element 28. In this case, upon generation of a negative pressure on the upstream side of the first rim-side valve element 28, the second rim-side valve element 32 in contact with the seat face 37*a* is swung downward to open the second rim-side ambient-air intake port 37. When the second rim-side ambient-air intake port 37 is opened, ambient air is taken into the water passage through the second rim-side ambient-air intake port 37. Thus, even if a negative pressure is generated on an upstream side of the second rim-side valve element 32, ambient air is introduced from the second rim-side ambient-air intake port 37 in such as manner as to cancel the negative pressure. This makes it possible to reduce the risk that flushing water on a downstream side of the second rim-side valve element 32 comes under the influence of a negative pressure generate on the upstream thereof In this embodiment, the sectional area of the second rim-side ambient-air intake port 37 is set at a value approximately equal to the sectional area of the water passage to allow a large volume of ambient air to be taken into the water passage so as to sufficiently block the influence of a negative pressure on the upstream side of the second rim-side valve element 32.

Then, when the second rim-side valve element 32 is further swung downward after being moved away from the seat face 37*a*, and brought into contact with the seat face 30*a* of the rim-side water inlet 30, the rim-side water inlet 30 is closed to preclude a negative pressure on the upstream side of the second rim-side valve element 32 from exerting its influence on the downstream side of the second rim-side valve element 32. This makes it possible to prevent the flushing water on the downstream side of the second rim-side valve element 32 from flowing back toward the upstream.

In the same manner, when a negative pressure is generated in a line adjacent to the valve inlet 18 in the jet-side water discharge state from some cause, such as a water failure in a water system for feeding flushing water, each of the first jet-side valve element 42 and the second jet-side valve element 46 is operable to prevent backflow of flushing water. Specifically, in the event that a negative pressure is generated on an upstream side of the first jet-side valve element 42, the first jet-side valve element 42 is moved downward to open the first jet-side ambient-air intake port 50. Thus, ambient air is introduced into the water passage, and the jet-side water inlet is closed to block the influence of the negative pressure on the upstream side of the first jet-side valve element 42. Further, if the first jet-side valve element 42 becomes unable to be normally moved, the second jet-side valve element 46 is swung downward. Thus, the second jet-side ambient-air intake port 49 is opened to introduce ambient air, and the jet-side water passage 44 is closed to block the influence of the negative pressure on the upstream side of the first jet-side valve element 42.

The malfunction of the first rim-side valve element 28 and the second rim-side valve element 32 would be caused by various factors, such as intervening of dusts or the like between sliding portions of the valve element and sticking of the packing to the seat face. In this embodiment, the first rim-side valve element 28 and the second rim-side valve element 32 are composed, respectively, of a linear motion type of valve element and the a swing-type of valve element. Thus, it is believed that the probability that a malfunction simultaneously occurs in them due to the same causal factor is extremely low. For the same reason, it is also believed that the probability that a malfunction simultaneously occurs in the first jet-side valve element 42 and the second jet-side valve element 46 due to the same causal factor is extremely low.

As above, in the water closet according to the first embodiment, each of the rim-side water passage and the jet-side water passage is provided with two valve elements for blocking influence of a negative pressure. Thus, even if either one of the valve elements becomes unable to be normally moved, backflow of flushing water can be blocked with significantly high reliability.

Further, in the water closet according to the first embodiment, the two valve elements interposed in each of the rim-side water passage and the jet-side water passage are different in motion type. This makes it possible to reduce the probability that a malfunction simultaneously occurs in them due to the same causal factor, so as to achieve further enhanced reliability as compared with a water-feed valve assembly where two valve elements are the same in motion type.

Furthermore, in the water closet according to the first embodiment, each of the ambient-air intake ports has a relatively large sectional area approximately equal to that of the water passage. Thus, in the event of generation of a negative pressure on the upstream side, a large volume of ambient air can be taken into the water passage to effectively block the influence of the negative pressure.

While the water closet according to the first embodiment is of a type designed to clean the inner wall surface of bowl 6 based on swirling flow, the present invention may be applied to any other suitable type of water closet, such as a box rim type or an open rim type. While the above embodiment has been described as an example where the water-feed valve assembly of the present invention is applied to a water closet, the water-feed valve assembly of the present invention may be applied to any other suitable apparatus. Further, while the above embodiment has been described as an example where the vacuum breaker of the present invention is applied to a water-feed valve assembly for water closets, the vacuum breaker of the present invention may be applied to any other suitable water-feed valve assembly and any other suitable apparatus.

Figure 7:
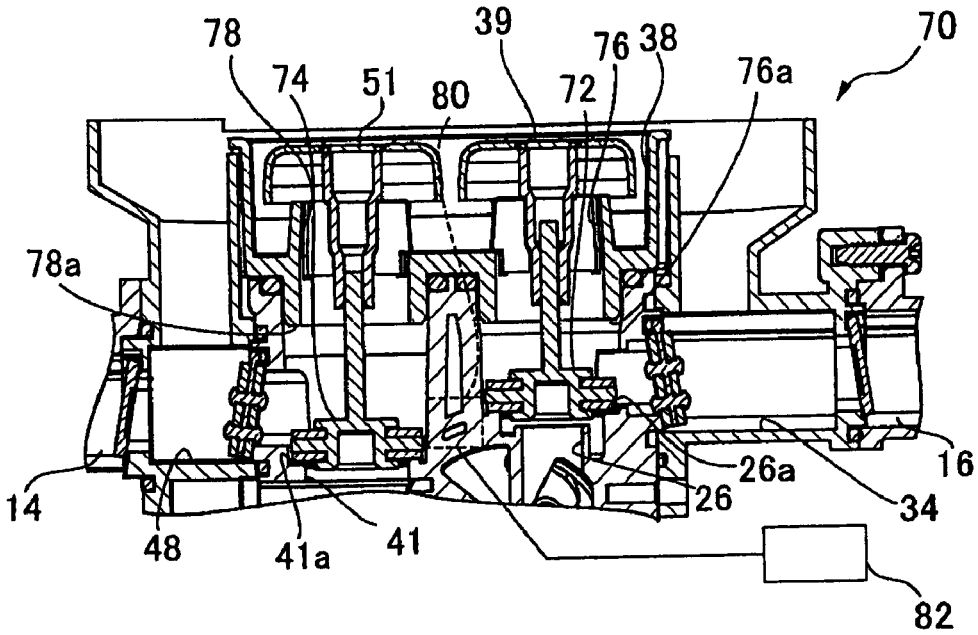
FIG. 7 is an enlarged sectional view showing a region of a vacuum breaker in a water-feed valve assembly used in a water closet according to a second embodiment of the present invention.

With reference to FIG. 7, a water closet according to a second embodiment of the present invention will be described below. The water closet according to the second embodiment is different from the first embodiment in the structure of a vacuum breaker used in a water-feed valve assembly. Thus, the following description will be made about only a difference between the first and second embodiments. Further, in FIG. 7, the same element or component as that in the first embodiment is defined by the same reference numeral, and its description will be omitted.

FIG. 7 is an enlarged sectional view showing a region of a vacuum breaker in a water-feed valve assembly used in the water closet according to the second embodiment. As shown in FIG. 7, the vacuum breaker 70 used in this embodiment comprises a rim-side valve element 72, a jet-side valve element 74, a rim-side ambient-air intake port 76 opened above the rim-side valve element 72, and a jet-side ambient-air intake port 78 opened above the jet-side valve element 74. The vacuum breaker 70 also includes a water-receiving member 38 formed to surround the rim-side ambient-air intake port 76 and the jet-side ambient-air intake port 78, a rim-side cover 39 disposed above the rim-side ambient-air intake port 76, and a jet-side cover 51 disposed above the jet-side ambient-air intake port 78. Further, the vacuum breaker 70 has a Hall IC 80 serving as operation detection means for detecting respective movements of the rim-side valve element 72 and the jet-side valve element 74, and a controller 82 serving as control means for controlling the water-feed valve based on a detection signal from the Hall IC 80.

The rim-side valve element 72 is operable, when flushing water is inhibited from passing through the water-feed valve assembly, to be in contact with a seat face 26*a* of a rim-side water inlet 26 so as to close the rim-side water inlet 26, and provide fluid communication between the rim-side ambient-air intake port 76 and a rim-side water outlet 34. Further, the rim-side valve element 72 is operable, when flushing water is permitted to pass through the water-feed valve assembly, to be moved upward by a stream of the flushing water and brought into contact with a seat face 76*a* of the rim-side ambient-air inlet port 76 so as to close rim-side ambient-air inlet port 76, and provide fluid communication between the rim-side water inlet 26 and the rim-side water outlet 34.

In a similar manner, the jet-side valve element 74 is operable, when flushing water is inhibited from passing through the water-feed valve assembly, to be in contact with a seat face 41*a* of a jet-side water inlet 41 so as to close the jet-side water inlet 41, and provide fluid communication between the jet-side ambient-air intake port 78 and a jet-side water outlet 48. Further, the jet-side valve element 74 is operable, when flushing water is permitted to pass through the water-feed valve assembly, to be moved upward by a stream of the flushing water and brought into contact with a seat face 78*a* of the jet-side ambient-air inlet port 78 so as to close jet-side ambient-air inlet port 78, and provide fluid communication between the jet-side water inlet 41 and the jet-side water outlet 48.

The Hall IC 80 is embedded in a wall surface between the rim-side water inlet 26 and the jet-side water inlet 41. Each of the rim-side valve element 72 and the jet-side valve element 74 is magnetized to allow a movement thereof to be detected by the Hall IC 80.

The controller 82 is electrically connected to the Hall IC 80 to receive an output signal of the Hall IC 80. The controller 82 is designed to detect whether a signal transmitted from the Hall IC indicates abnormality, and, when abnormality is detected in the signal, generate an alarm and shut off a water system line fluidically connected to the water-feed valve assembly.

An operation of the water closet according to the second embodiment will be described below. An operation for sequentially discharging flushing water from a rim portion and a jet nozzle in response to a user's operation is the same as that in the water closet according to the first embodiment, and its description will be omitted. Further, operations of the rim-side valve element 72 and the jet-side valve element 74 are the same as those of the first rim-side valve element 28 and the first jet-side valve element 42 in the first embodiment, respectively, and their description will be omitted.

Respective operations of the Hall IC and the controller 82 will be described herein. The Hall IC 80 is operable to detect a movement of a magnetized object when the object is moved in the vicinity thereof, and generate a signal. In this embodiment, the rim-side valve element 72 and the jet-side valve element 74 are magnetized, and thereby each movement of the rim-side valve element 72 and the jet-side valve element 74 is detected by the Hall IC 80. In a normal operational state of the vacuum breaker, the rim-side valve element 72 is moved upward when flushing water is supplied to the rim portion, and moved downward after completion of the flushing water supply to the rim portion. Further, the jet-side valve element 74 is moved upward when flushing water is supplied to the jet nozzle, and moved downward after completion of the flushing water supply to the jet nozzle. The Hall IC 80 detects respective movements of the rim-side valve element 72 and the jet-side valve element 74, and sends the detection signal to the controller 82. When the signal sent from the Hall IC 80 indicates normality in respective operations of the rim-side valve element 72 and the jet-side valve element 74, the controller 82 generates no alarm. If the signal from the Hall IC 80 indicates abnormality or malfunction, the controller 82 generates an alarm to inform a user about the abnormality in the vacuum breaker. For example, if a signal indicative of downward movement of the rim-side valve element 72 is not entered into the controller 82 even after completion of the flushing water supply to the rim portion, it is likely that the rim-side ambient-air inlet port 76 is kept in its closed state due to sticking of the rim-side valve element 72 to the seat face 76*a* of the rim-side ambient-air inlet port 76. Thus, the controller 82 generates an alarm by means of blinking of a LED, warning sound or the like. Alternatively, the controller 82 may be designed to shut off fluid communication between the water-feed valve assembly and the water system line in response to detection of a malfunction by the controller 82.

In the water closet according to the second embodiment of the present invention, the controller monitors the operation of the vacuum breaker. Then, in response to detecting a malfunction of the vacuum breaker, the controller generates an alarm or shits off fluid communication with a water system. Thus, the vacuum breaker can prevent backflow of flushing water to the water system with enhanced reliability.

Figure 8:
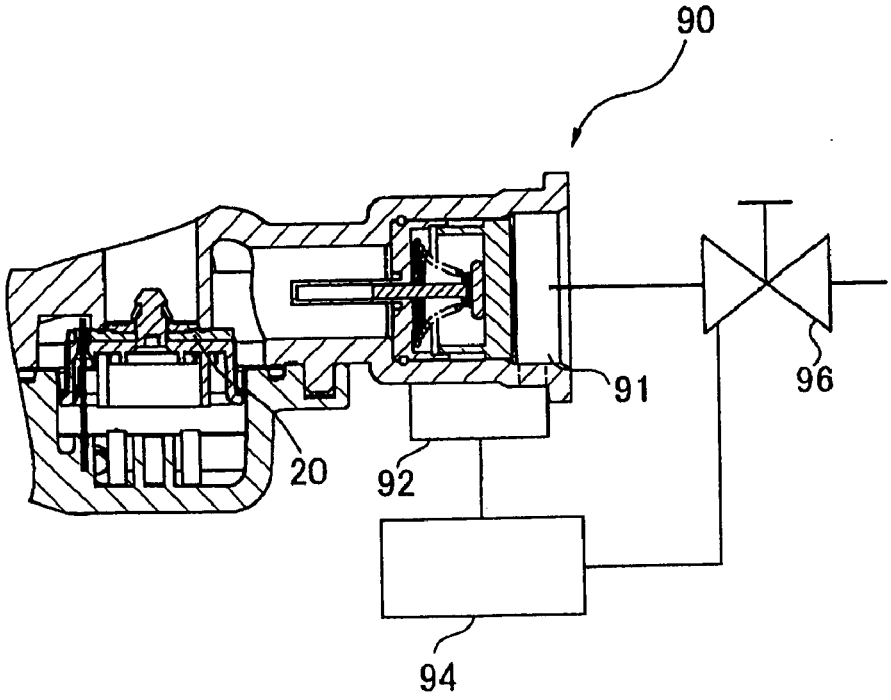
FIG. 8 is an enlarged sectional view showing an inlet of one modification of the water-feed valve assembly.

One modification of the water-feed valve as shown in FIG. 8 may be used for preventing backflow of flushing water to the water system. FIG. 8 is an enlarged sectional view showing an inlet of the modification of the water-feed valve assembly. This water-feed valve assembly 90 comprises an inlet line 91 fluidically connected to a water system and adapted to lead water from the water system to a body of the water-feed valve assembly, a pressure sensor 92 for measuring an internal pressure of the inlet line 91, and a controller 94 for controlling a valve 96 interposed in an upstream line relative to the inlet line 91 based on a pressure detected by the pressure sensor 92.

The pressure sensor 92 is attached to the inlet line 91 of the water-feed valve assembly fluidically connected to the water system to measure an internal pressure of the inlet line 91. A signal detected by the pressure sensor 92 is input to the controller 94. If the pressure detected by the pressure sensor 92 becomes equal to or less than a predetermined value, the controller 94 sends a control signal to the valve 96 so as to shut off the valve 96.

In the water-feed valve assembly, when an internal pressure of the inlet line 91 becomes equal to or less than the predetermined value to cause the risk of backflow, the valve 96 interposed in the upstream line relative to the inlet line 91 is shut off. This makes it possible to prevent backflow from the water-feed valve assembly to the water system.

What is claimed is:

1. A vacuum breaker comprising:

a main body having a water inlet, a water outlet, a water passage for fluidically connecting said water inlet and said water outlet, and first and second ambient-air intake ports for allowing said water passage to fluidically communicate with ambient air therethrough;

a first valve element disposed in said main body; and a second valve element disposed in said main body at a position downstream of said first valve element, wherein:

said first valve element is designed to be movable between a first position where said first valve element closes said first ambient-air intake port and opens said water inlet so as to allow said water inlet to fluidically communicate with a zone of said water passage between said first and second valve elements, when water is permitted to pass through said water passage, and a second position where said first valve element closes said water inlet and opens said first ambient-air intake port so as to allow said first ambient-air intake port to fluidically communicate with the zone of said water passage between said first and second valve elements, when water is inhibited from passing through said water passage; and said second valve element is designed to be movable between a first position where said second valve element closes said second ambient-air intake port and opens the zone of said water passage between said first and second valve elements so as to allow the zone of said water passage between said first and second valve elements to fluidically communicate with said water outlet, when water is permitted to pass through said water passage, and a second position where said second valve element closes the zone of said water passage between said first and second valve elements and opens said second ambient-air intake port so as to allow said second ambient-air intake port to fluidically communicate with said water outlet, when water is inhibited from passing through said water passage.

2. The vacuum breaker according to claim 1, wherein said first and second valve elements are different from one another in motion type.

3. The vacuum breaker according to claim 2, wherein one of said first and second valve elements is a linear motion-type of valve element, and the other thereof is a swing-type valve element.

4. The vacuum breaker according to claim 1, further comprising a water-receiving member for receiving therein water spilling out of said first ambient-air intake port, and a transfer line for allowing water spilling out of said second ambient-air intake port to flow in said water-receiving member.

5. The vacuum breaker according to claim 1, further comprising a water-receiving member for receiving therein water spilling out of said second ambient-air intake port, and a transfer line for allowing water spilling out of said first ambient-air intake port to flow in said water-receiving member.

6. A water-feed valve assembly comprising:

the vacuum breaker according to claim 1;

a main valve element designed to selectively provide fluid communication between a water system and the water inlet of said vacuum breaker, and shut off the fluid communication between the water system and the water inlet of said vacuum breaker; and a water discharge line fluidically connected to the water outlet of said vacuum breaker.

7. A water-feed valve assembly for supplying flushing water to a water closet of a type designed to be fluidically connected directly to a water system, comprising:

a rim-side water discharge line for allowing flushing water to be discharged from a rim portion of said water closet;

a first vacuum breaker consisting of the vacuum breaker according to claim 1, the water outlet of said first vacuum breaker being fluidically connected to said rim-side water discharge line;

a jet-side water discharge line for allowing flushing water to be discharged from a jet nozzle of said water closet;

a second vacuum breaker consisting of the vacuum breaker according to claim 1, the water outlet of said second vacuum breaker being fluidically connected to said jet-side water discharge line;

a main valve element interposed in a connection line to a water system and designed to switch between a water stop state and a water discharge state; and a selector valve designed to allow flushing water fed from said water system through said main valve element to be selectively led to either one of the water inlet of said first vacuum breaker and the water inlet of said second vacuum breaker.

8. A water closet comprising:

a water closet body including a bowl which has an upper portion formed as a rim portion, and a jet nozzle disposed at a bottom portion of said bowl; and the water-feed valve assembly according to claim 7.

* * * * *